US006291566B1

(12) United States Patent
Shin et al.

(10) Patent No.: US 6,291,566 B1
(45) **Date of Patent: *Sep. 18, 2001**

(54) HYDROCARBON/CO-SOLVENT SPIN LIQUIDS FOR FLASH-SPINNING POLYMERIC PLEXIFILAMENTS

(75) Inventors: Hyunkook Shin, Wilmington; Sam Louis Samuels, Claymont, both of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/279,317

(22) Filed: Jul. 22, 1994

Related U.S. Application Data

(63) Continuation of application No. 08/096,568, filed on Jul. 30, 1993, now abandoned, which is a continuation of application No. 07/859,562, filed on Mar. 26, 1992, now abandoned, which is a division of application No. 07/660,768, filed on Feb. 22, 1991, now Pat. No. 5,147,586.

(51) Int. Cl.[7] ..... C08L 5/05
(52) U.S. Cl. ..... 524/390; 524/462
(58) Field of Search ..... 524/390, 462

(56) References Cited

U.S. PATENT DOCUMENTS

| | | | | |
|---|---|---|---|---|
| 3,081,519 | | 3/1963 | Blades et al. | 28/81 |
| 3,227,784 | | 1/1966 | Blades et al. | 264/53 |
| 3,227,794 | | 1/1966 | Anderson et al. | 264/205 |
| 4,112,029 | | 9/1978 | Sander et al. | 264/11 |
| 4,539,394 | * | 9/1985 | Fenton et al. | 525/240 |
| 5,032,326 | | 7/1991 | Shin | 264/13 |
| 5,043,108 | | 8/1991 | Samuels | 264/13 |
| 5,342,567 | * | 8/1994 | Chen et al. | 264/203 |

FOREIGN PATENT DOCUMENTS

| | | |
|---|---|---|
| 0357364 | 3/1990 | (EP) . |
| 891943 | 3/1962 | (GB) . |
| 891945 | 3/1962 | (GB) . |

OTHER PUBLICATIONS

P.S. Zurer, "Search Intensifies for Alternatives to Ozone Depleting Halocarbons," Chem & Eng. News, pp. 17–20 (Feb. 8, 1988).

* cited by examiner

*Primary Examiner*—Peter D. Mulcahy

(57) ABSTRACT

An improved process is provided for flash-spinning plexifilamentary film-fibril strands of a fiber-forming polyolefin from a $C_{4-7}$ hydrocarbon/co-solvent spin liquid that, if released to the atmosphere, presents a greatly reduced ozone depletion hazard, as compared to the halocarbon spin liquids currently-used commercially for making such strands. The resulting plexifilamentary film-fibril strands have increased tenacity and improved fibrillation compared to strands flash-spun from 100% hydrocarbon spin liquids.

8 Claims, 11 Drawing Sheets

HYDROCARBON/CO-SOLVENT SPIN LIQUIDS FOR FLASH-SPINNING POLYMERIC PLEXIFILAMENTS

This is a continuation of application Ser. No. 08/096,568 filed Jul. 30, 1993, now abandoned, which was a continuation of application Ser. No. 07/859,562 filed Mar. 26, 1992, now abandoned, which is in turn a divisional of application Ser. No. 07/660,768, filed Feb. 22, 1991, now U.S. Pat. No. 5,147,586.

FIELD OF THE INVENTION

The invention generally relates to flash-spinning polymeric film-fibril strands. More particularly, the invention concerns an improvement in such a process which permits flash-spinning of the strands from hydrocarbon/co-solvent spin liquids which, if released to the atmosphere, would not detrimentally affect the earth's ozone layer. Strands produced by flash-spinning from hydrocarbon/co-solvent spin liquids have higher tenacity and improved fibrillation over strands produced by flash-spinning from 100% hydrocarbon spin liquids.

BACKGROUND OF THE INVENTION

U.S. Pat. No. 3,081,519 (Blades et al.) describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash-spinning causes the liquid to vaporize and thereby cool the exudate which forms a plexifilamentary film-fibril strand of the polymer. Preferred polymers include crystalline polyhydrocarbons such as polyethylene and polypropylene.

According to Blades et al. in both U.S. Pat. No. 3,081,519 and U.S. Pat. No. 3,227,784, a suitable liquid for the flash spinning desirably (a) has a boiling point that is at least 25° C. below the melting point of the polymer; (b) is substantially unreactive with the polymer at the extrusion temperature; (c) should be a solvent for the polymer under the pressure and temperature set forth in the patent (i.e., these extrusion temperatures and pressures are respectively in the ranges of 165 to 225° C. and 545 to 1490 psia); (d) should dissolve less than 1% of the polymer at or below its normal boiling point; and should form a solution that will undergo rapid phase separation upon extrusion to form a polymer phase that contains insufficient solvent to plasticize the polymer. Depending on the particular polymer employed, the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as trichlorofluoromethane, methylene chloride, carbon tetrachloride, chloroform, ethyl chloride, methyl chloride; alcohols; esters; ethers; ketones; nitrites; amides; fluorocarbons; sulfur dioxide; carbon disulfide; nitromethane; water; and mixtures of the above liquids. The patents illustrate certain principles helpful in establishing optimum spinning conditions to obtain plexifilamentary strands. Blades et al. state that the flash-spinning solution additionally may contain a dissolved gas, such as nitrogen, carbon dioxide, helium, hydrogen, methane, propane, butane, ethylene, propylene, butene, etc to assist nucleation by increasing the "internal pressure" and lowering the surface tension of the solution. Preferred for improving plexifilamentary fibrillation are the less soluble gases, i.e., those that are dissolved to a less than 7% concentration in the polymer solution under the spinning conditions. Common additives, such as antioxidants, UV stabilizers, dyes, pigments and the like also can be added to the solution prior to extrusion.

U.S. Pat. No. 3,227,794 (Anderson et al.) discloses a diagram similar to that of Blades et al. for selecting conditions for spinning plexifilamentary strands. A graph is presented of spinning temperature versus cloud-point pressure for solutions of 10 to 16 weight percent of linear polyethylene in trichlorofluoromethane. Anderson et al. describe in detail the preparation of a solution of 14 weight percent high density linear polyethylene in trichlorofluoromethane at a temperature of about 185° C. and a pressure of about 1640 psig which is then flash-spun from a let-down chamber at a spin temperature of 185°C. and a spin pressure of 1050 psig. Very similar temperatures, pressures and concentrations have been employed in commercial flash-spinning of polyethylene into plexifilamentary film-fibril strands, which were then converted into sheet structures.

Although trichlorofluoromethane has been a very useful solvent for flash-spinning plexifilamentary film-fibril strands of polyethylene, and has been the dominant solvent used in commercial manufacture of polyethylene plexifilamentary strands, the escape of such a halocarbon into the atmosphere has been implicated as a source of depletion of the earth's ozone layer. A general discussion of the ozone-depletion problem is presented, for example, by P.S. Zurer, "Search Intensifies for Alternatives to Ozone-Depleting Halocarbons", *Chemical & Engineering News*, pages 17–20 (Feb. 8, 1988).

Clearly, what is needed is a flash-spinning process which uses a spin liquid which does not have the deficiencies inherent in the prior art. It is therefore an object of this invention to provide an improved process for flash-spinning plexifilamentary film-fibril strands of a fiber-forming polyolefin, wherein the spin liquid used for flash-spinning is not a depletion hazard to the earth's ozone layer. It is also an object of this invention to provide an improved process for flash-spinning plexifilamentary film-fibril strands of fiber-forming polyolefin, wherein the resulting flashspun plexifilaments have increased tenacity and improved fibrillation. Others objects and advantages of the present invention will become apparent to those skilled in the art upon reference to the detailed description of the invention which hereinafter follows.

SUMMARY OF THE INVENTION

In accordance with the invention, there is provided an improved process for flash-spinning plexifilamentary film-fibril strands of a fiber-forming polyolefin. Preferably, the polyolefin is polyethylene or polypropylene.

In one embodiment, the invention comprises an improved process for flash-spinning plexifilamentary film-fibril strands wherein polyethylene is dissolved in a hydrocarbon/co-solvent spin liquid to form a spin mixture containing 8 to 35 percent of polyethylene by weight of the spin mixture at a temperature in the range of 130 to 300° C. and a mixing pressure that is greater than 1500 psig, preferably greater than the cloud-point pressure of the spin mixture, which spin mixture is flash-spun at a spin pressure of greater than 1500 psig into a region of substantially lower temperature and pressure. The improvement comprises the spin liquid consisting essentially of a hydrocarbon spin liquid containing 4 to 5 carbon atoms and having an atmospheric boiling point less than 45° C. and a co-solvent spin liquid having an atmospheric boiling point less than 100° C., preferably between −100° C. and 100° C. The amount of the co-solvent spin liquid to be added to the $C_{4-5}$ hydrocarbon spin liquid must be greater than 10 percent by weight of the $C_{4-5}$ hydrocarbon spin liquid and the co-solvent spin liquid and must be sufficient to raise the cloud-point pressure of the resulting spin mixture by more than 200 psig, preferably more than 500 psig, at the polyethylene concentration and the spin temperature used for flash-spinning.

Preferably, the $C_{4-5}$ hydrocarbon spin liquid is selected from the group consisting of isobutane, butane, cyclobutane, 2-methyl butane, 2,2-dimethyl propane, pentane, methyl cyclobutane and mixtures thereof. Presently, the most preferred hydrocarbon spin liquids are butane, pentane and 2-methyl butane. Preferably, the co-solvent spin liquid comprises an inert gas such as carbon dioxide; a hydrofluorocarbon such as pentafluoroethane (hereinafter "HFC-1251"), 1,1,1,2-tetrafluoroethane (hereinafter "HFC-134a"), 1,1-difluoroethane (hereinafter "HFC-152a") and their isomers; a hydrochlorofluorocarbon; a perfluorinated hydrocarbon; a polar solvent such as methanol, ethanol, propanol, isopropanol, 2-butanone, and tert-butyl alcohol; and mixtures thereof.

In another embodiment, the invention comprises an improved process for flash-spinning plexifilamentary film-fibril strands wherein polyethylene is dissolved in a hydrocarbon/co-solvent spin liquid to form a spin mixture containing 8 to 35 percent of polyethylene by weight of the spin mixture at a temperature in the range of 130 to 300° C. and a mixing pressure that is greater than 700 psig, preferably greater than the cloud-point pressure of the spin mixture, which spin mixture is flash-spun at a spin pressure of greater than 700 psig into a region of substantially lower temperature and pressure. The improvement comprises the spin liquid consisting essentially of a hydrocarbon spin liquid containing 5 to 7 carbon atoms and having an atmospheric boiling point between 45° C. to 100° C. and a co-solvent spin liquid having an atmospheric boiling point less than 100° C., preferably between −100° C. and 100° C. The amount of the co-solvent spin liquid to be added to the $C_{5-7}$ hydrocarbon spin liquid must be greater than 10 percent by weight of the $C_{5-7}$ hydrocarbon spin liquid and the co-solvent spin liquid and must be sufficient to raise the cloud-point pressure of the resulting spin mixture by more than 200 psig, preferably more than 500 psig, at the polyethylene concentration and the spin temperature used for flash-spinning.

Preferably, the $C_{5-7}$ hydrocarbon spin liquid is selected from the group consisting of cyclopentane, 2,2-dimethylbutane, 2,3-dimethylbutane, 2-methylpentane, 3-methylpentane, hexane, methyl cyclopentane, cyclohexane, 2-methyl hexane, 3-methyl hexane, heptane and mixtures thereof. Preferably, the co-solvent spin liquid comprises an inert gas such as carbon dioxide; a hydrofluorocarbon such as HFC-125, HFC-134a, HFC-152a and their isomers; a hydrochlorofluorocarbon; a perfluorinated hydrocarbon; a polar solvent such as methanol, ethanol, propanol, isopropanol, 2-butanone and tert-butyl alcohol; and mixtures thereof.

In a preferred mode of the first embodiment, the polyethylene has a melt index greater than 0.1 but less than 100, most preferably less than 4, and a density of between 0.92–0.98, and it is dissolved in a hydrocarbon/co-solvent spin liquid consisting essentially of pentane and methanol to form a spin mixture containing 8 to 35 percent of the polyethylene by weight of the spin mixture at a temperature in the range of 130 to 300° C. and a mixing pressure that is greater than 1500 psig, followed by flash-spinning the spin mixture at a spin pressure greater than 1500 psig into a region of substantially lower temperature and pressure. The methanol comprises between 10 to 40 percent by weight of the pentane/methanol spin liquid.

In another embodiment, the invention comprises an improved process for flash-spinning plexifilamentary film-fibril strands wherein polypropylene is dissolved in a hydrocarbon/co-solvent spin liquid to form a spin mixture containing 8 to 30 percent of polypropylene by weight of the spin mixture at a temperature in the range of 150 to 250° C. and a mixing pressure that is greater than 700 psig, preferably greater than the cloud-point pressure of the spin mixture, which spin mixture is flash-spun at a spin pressure of greater than 700 psig into a region of substantially lower temperature and pressure. The improvement comprises the spin liquid consisting essentially of a hydrocarbon spin liquid containing 4 to 7 carbon atoms and having an atmospheric boiling point less than 100° C. and a co-solvent spin liquid having an atmospheric boiling point less than 100° C., preferably between −100° C. and 100° C. The amount of the co-solvent spin liquid to be added to the $C_{4-7}$ hydrocarbon spin liquid must be greater than 10 percent by weight of the $C_{4-7}$ hydrocarbon spin liquid and the co-solvent spin liquid and must be sufficient to raise the cloud-point pressure of the resulting spin mixture by more than 200 psig, preferably more than 500 psig, at the polypropylene concentration and the spin temperature used for flash-spinning.

Preferably, the $C_{4-7}$ hydrocarbon spin liquid is selected from the group consisting of isobutane, butane, cyclobutane, 2-methyl butane, 2,2-dimethyl propane, pentane, methyl cyclobutane, cyclopentane, 2,2-dimethylbutane, 2,3-dimethylbutane, 2-methylpentane, 3-methylpentane, hexane, methyl cyclopentane, cyclohexane, 2-methyl hexane, 3-methyl hexane, heptane and mixtures thereof. Presently, the most preferred hydrocarbon spin liquids are butane, pentane and 2-methyl butane. Preferably, the co-solvent spin liquid comprises an inert gas such as carbon dioxide; a hydrofluorocarbon such as HFC-125, HFC-134a, HFC-152a and their isomers; a hydrochlorofluorocarbon; a perfluorinated hydrocarbon; a polar solvent such as methanol, ethanol, propanol, isopropanolf 2-butanone and tert-butyl alcohol; and mixtures thereof.

The present invention provides a novel flash-spinning spin mixture consisting essentially of 8 to 35 weight percent of a fiber-forming polyolefin, preferably polyethylene or polypropylene, and 65 to 92 weight percent of a spin liquid, the spin liquid consisting essentially of-less than 90 weight percent of a $C_{4-7}$ hydrocarbon spin liquid selected from the group consisting of isobutane, butane, cyclobutane, 2-methyl butane, 2,2-dimathyl propane, pentans, methyl cyclobutane, cyclopentane, 2,2-dimethylbutane, 2,3-dimethylbutane, 2-methylpentane,3-methylpentane, hexane, methyl cyclopentane, cyclohexane, 2-methyl hexane, 3-methyl hexane, heptane and mixtures thereof and greater than 10 weight percent of a co-solvent spin liquid having an atmospheric boiling point less than 100° C. and selected from the group consisting of an inert gas, a hydrofluorocarbon, a hydrochlorofluorocarbon, a perfluorinated hydrocarbon, a polar solvent and mixtures thereof. Preferably, the $C_{4-7}$ hydrocarbon spin liquid is pentane and the co-solvent spin liquid is methanol.

BRIEF DESCRIPTION OF THE DRAWINGS

The following Figures are provided to illustrate the cloud-point pressures curves of selected spin mixtures at varying co-solvent spin liquid concentrations and spin temperatures.

DETAILED DESCRIPTION OF THE PREFERRED EMBODIMENTS

Figure 1:
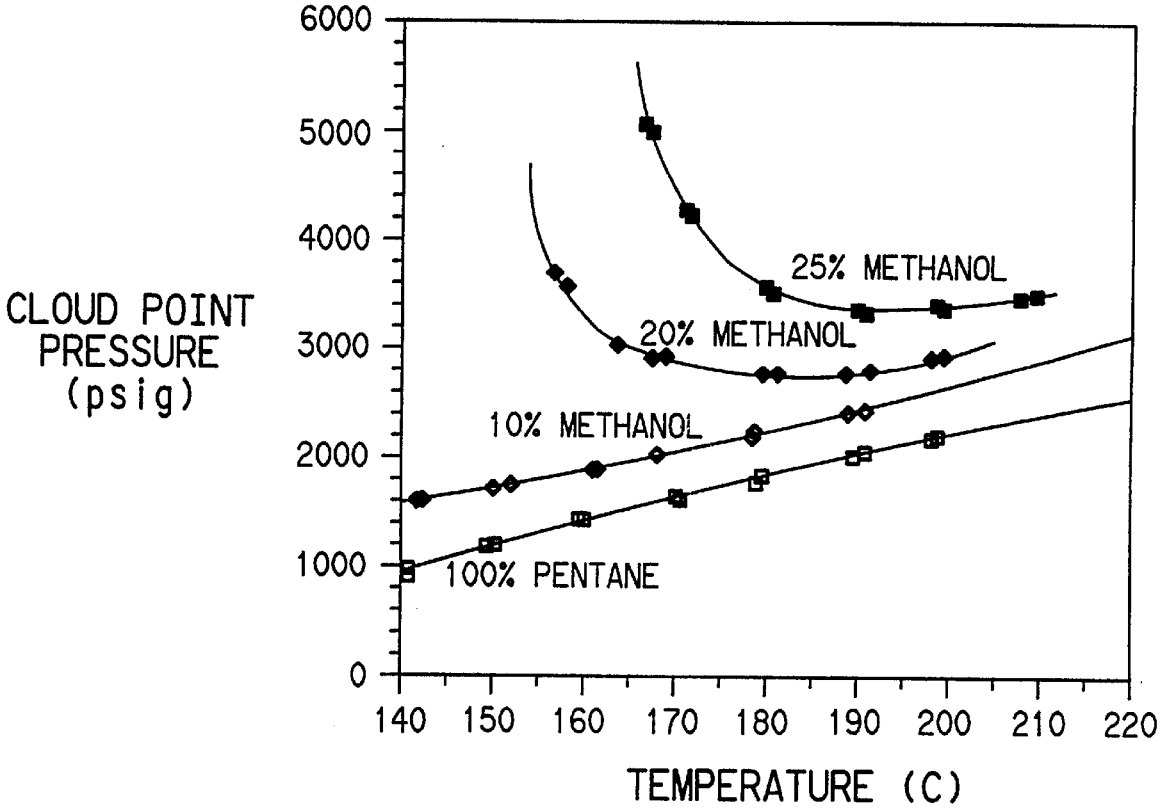
FIG. 1 is a cloud-point pressure curve for 22 weight percent polyethylene in a pentane/methanol spin liquid.

The term "polyolefin" as used herein, is intended to mean any of a series of largely saturated open chain polymeric hydrocarbons composed only of carbon and hydrogen. Typical polyolefins include, but are not limited to, polyethylene, polypropylene, and polymethylpentene. Conveniently, polyethylene and polypropylene are the preferred polyolefins for use in the process of the present invention.

"Polyethylene" as used herein is intended to embrace not only homopolymers of ethylene, but also copolymers wherein at least 85% of the recurring units are ethylene units. One preferred polyethylene is a linear high density polyethylene which has an upper limit of melting range of about 130 to 135° C., a density in the range of 0.94 to 0.98 g/cm$^3$ and a melt index (as defined by ASTM D-1238-57T, Condition E) of between 0.1 to 100, preferably less than 4.

The term "polypropylene" is intended to embrace not only homopolymers of propylene but also copolymers wherein at least 85% of the recurring units are propylene units.

The term "plexifilamentary film-fibril strands" as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail in U.S. Pat. No. 3,081,519 (Blades et al.) and in U.S. Pat. No. 3,227,794 (Anderson et al.), the contents of which are incorporated herein.

The term "cloud-point pressure" as used herein, means the pressure at which a single liquid phase starts to phase separate into a polyolefin-rich/spin liquid-rich two phase liquid dispersion.

The term "hydrocarbon spin liquid", means any $C_4$ to $C_7$ alkane or cycloalkane (i.e., butane, pentane, hexane and heptane) and their structural isomers. It will be understood that the hydrocarbon spin liquid can be made up of a single $C_{4-7}$ hydrocarbon liquid or mixtures thereof.

The term "co-solvent spin liquid" as used herein, means a miscible spin liquid that is added to a hydrocarbon spin liquid containing a dissolved polyolefin to raise the cloud-point pressure of the resulting spin mixture (i.e., the co-solvent, hydrocarbon spin liquid and polyolefin) by more than 200 psig, preferably more than 500 psig, at the polyolefin concentration and the spin temperature used for flash-spinning. The co-solvent spin liquid is a non-solvent for the polyolefin, or at least a poorer solvent than the hydrocarbon spin liquid, and has an atmospheric boiling point less than 100° C., preferably between −100° C. and 100° C. (In other words, the solvent power of the co-solvent spin liquid used must be such that if the polyolefin to be flash-spun were to be dissolved in the co-solvent spin liquid alone, the polyolefin would not dissolve in the co-solvent spin liquid, or the resultant solution would have a cloud-point pressure greater than about 7000 psig). Preferably, the co-solvent spin liquid is an inert gas like carbon dioxide; a hydrofluorocarbon like HFC-125, HFC-134a, HFC-152a and their isomers; a hydrochlorofluorocarbon; a perfluorinated hydrocarbon; a polar solvent like methanol, ethanol, propanol, isopropanol, 2-butanone and tert-butyl alcohol; and mixtures thereof. The co-solvent spin liquid must be present in an amount greater than 10 weight percent of the total weight of the co-solvent spin liquid and the hydrocarbon spin liquid. It will be understood that the co-solvent spin liquid can be made up of one co-solvent or mixtures of co-solvents.

The present invention provides an improvement in the known process for producing plexifilamentary film-fibril strands of fiber-forming polyolefins from a spin liquid that contains the fiber-forming polyolefin. In the known processes, which were described in the above-mentioned U.S. patents, a fiber-forming polyolefin, e.g. linear polyethylene, is typically dissolved in a spin liquid that includes a halocarbon to form a spin solution containing about 10 to 20 percent of the linear polyethylene by weight of the solution and then is flash-spun at a temperature in the range of 130 to 230° C. and a pressure that is greater than the autogenous pressure of the spin liquid into a region of substantially lower temperature and pressure.

The key improvement of the present invention requires that the spin liquid consist essentially of a hydrocarbon/co-solvent spin liquid that has a greatly reduced ozone depletion potential and the ability of producing plexifilamentary strands having increased tenacity and improved fibrillation over the known processes. In this invention, well-fibrillated, high tenacity plexifilaments can be successfully produced using a hydrocarbon spin liquid combined with a co-solvent spin liquid. The hydrocarbon spin liquid comprises a $C_{4-7}$ hydrocarbon having an atmospheric boiling point less than 100° C. The co-solvent spin liquid must be a non-solvent for the polyolefin, or at least a poorer solvent than the hydrocarbon spin liquid, and must have an atmospheric boiling point less than 100° C., preferably between −100° C. and 100° C. Additionally, the co-solvent spin liquid must be added to the hydrocarbon spin liquid in an amount greater than 10 weight percent of the total hydrocarbon spin liquid and the co-solvent spin liquid present in order that the co-solvent spin liquid may act as a true co-solvent and not as a nucleating agent. The purpose of adding the co-solvent spin liquid to the hydrocarbon spin liquid is to obtain higher tensile properties and improved fibrillation in the resulting plexifilaments than obtainable using a hydrocarbon spin liquid alone.

Figure 2:
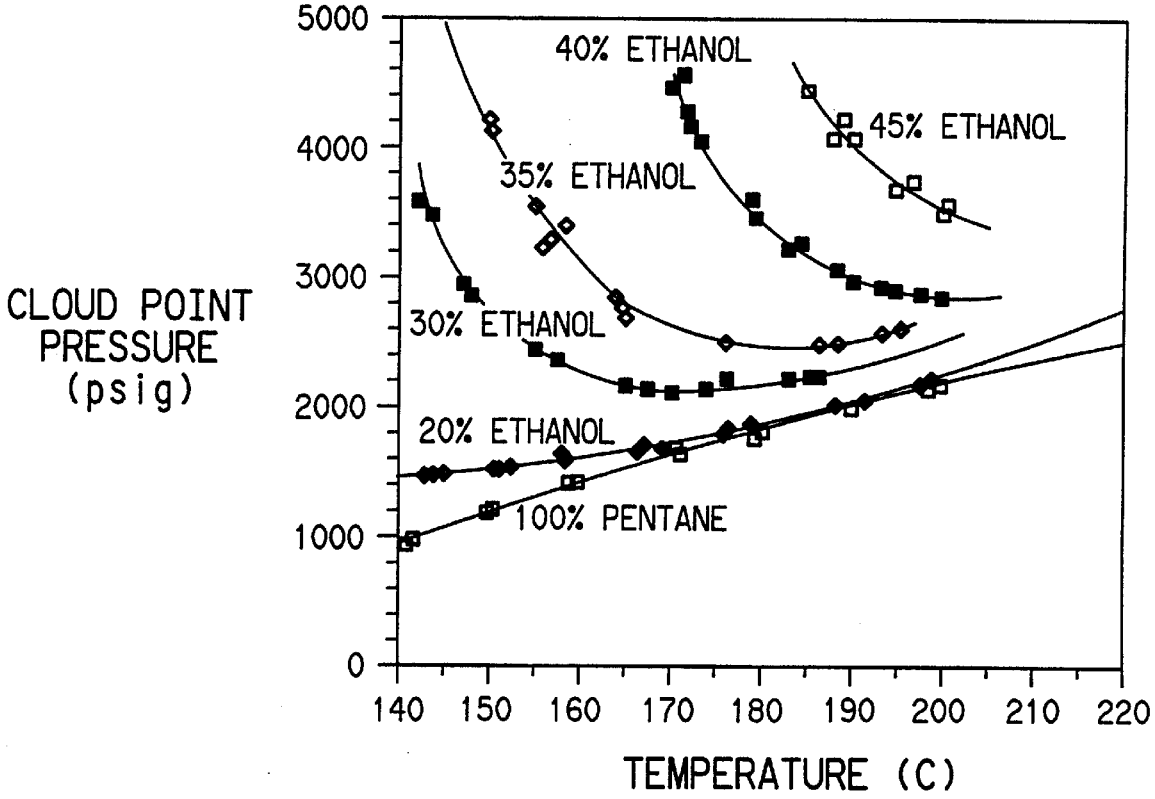
FIG. 2 is a cloud-point pressure curve for 22 weight percent polyethylene in a pentane/ethanol spin liquid.
Figure 3:
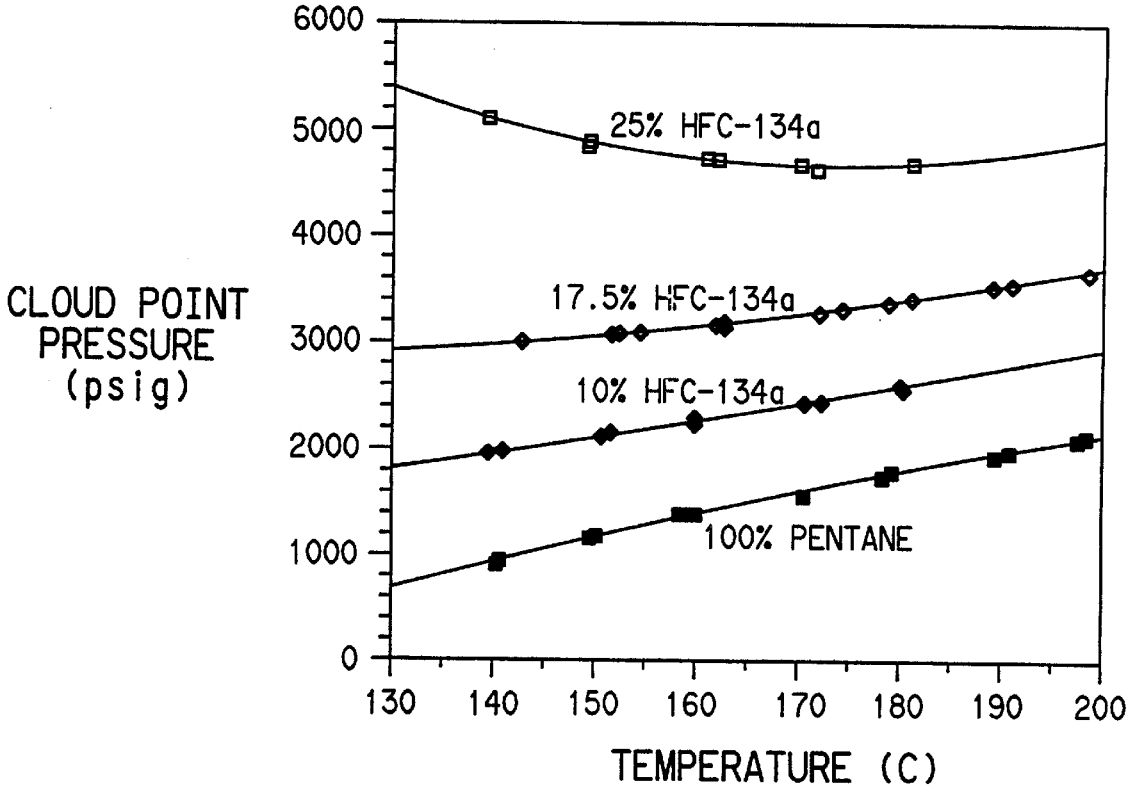
FIG. 3 is a cloud-point pressure curve for 22 weight percent polyethylene in a pentane/HFC-134a spin liquid.
Figure 4:
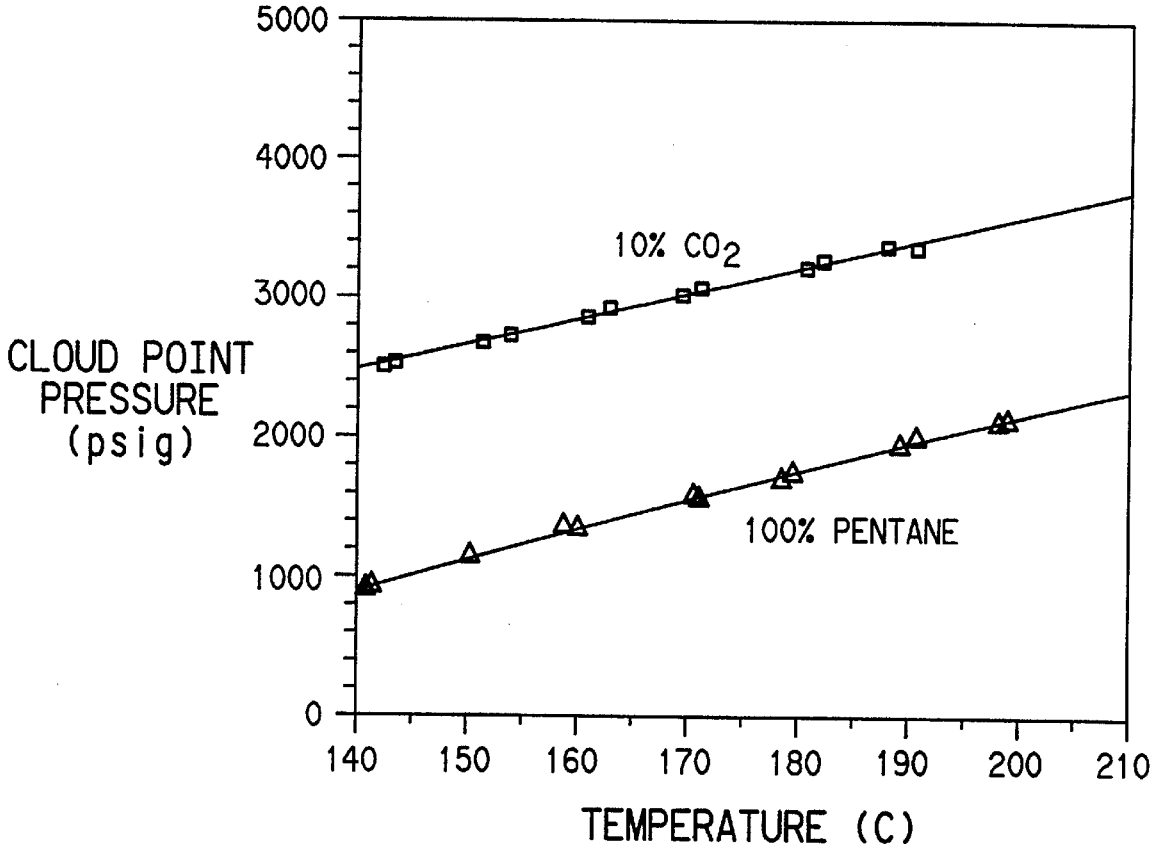
FIG. 4 is a cloud-point pressure curve for 22 weight percent polyethylene in a pentane/carbon dioxide spin liquid.
Figure 5:
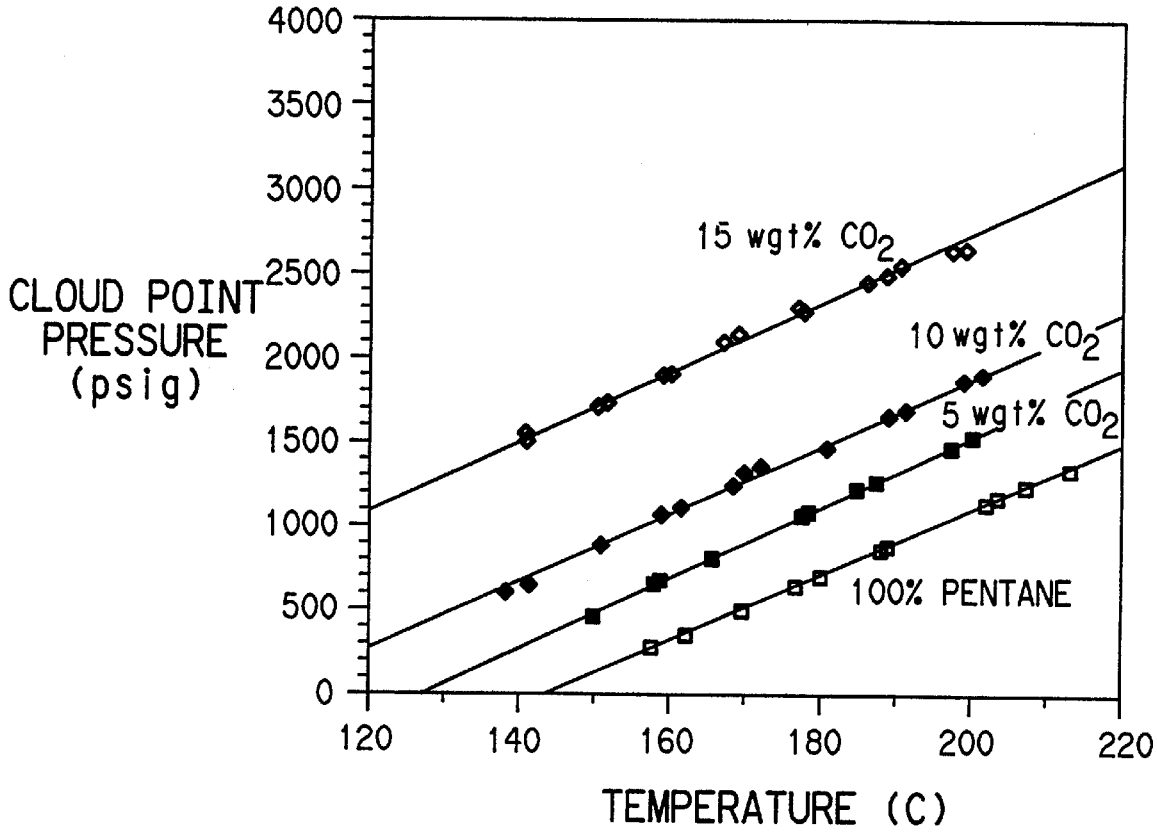
FIG. 5 is a cloud-point pressure curve for 22 weight percent polypropylene in a pentane/carbon dioxide spin liquid.
Figure 6:
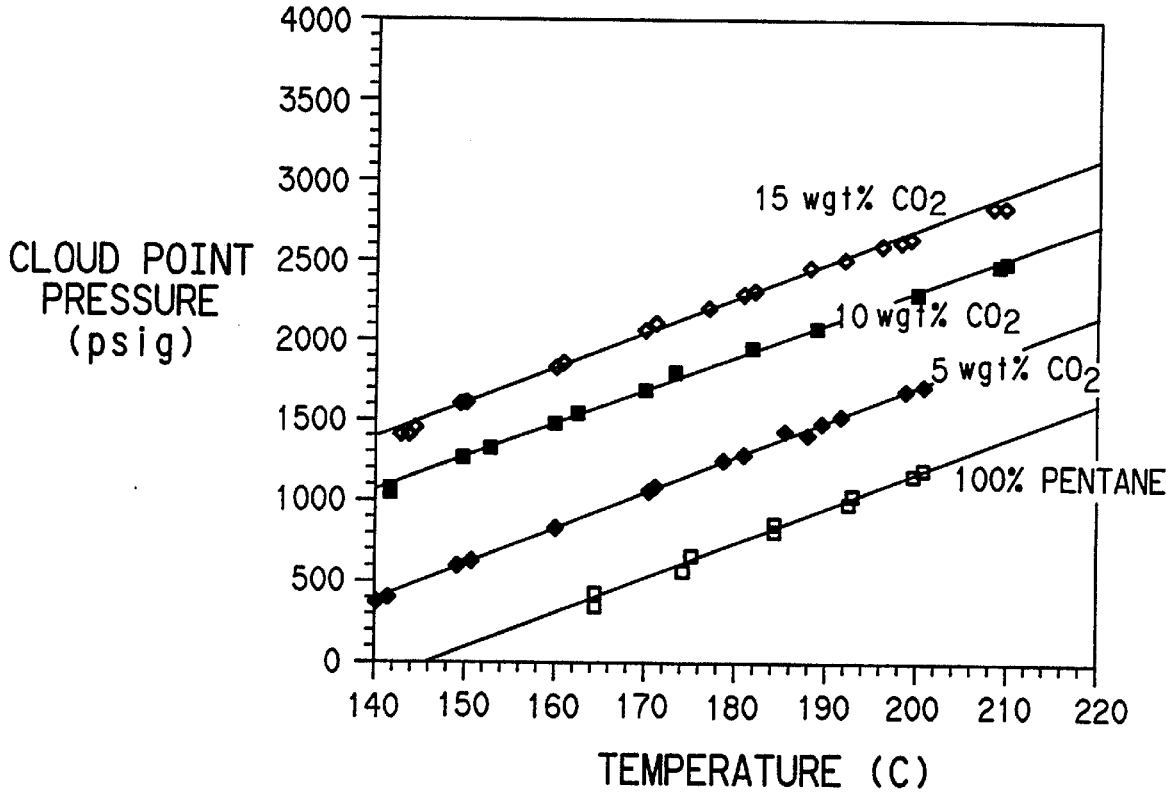
FIG. 6 is a cloud-point pressure curve for 14 weight percent polypropylene in a pentane/carbon dioxide spin liquid.
Figure 7:
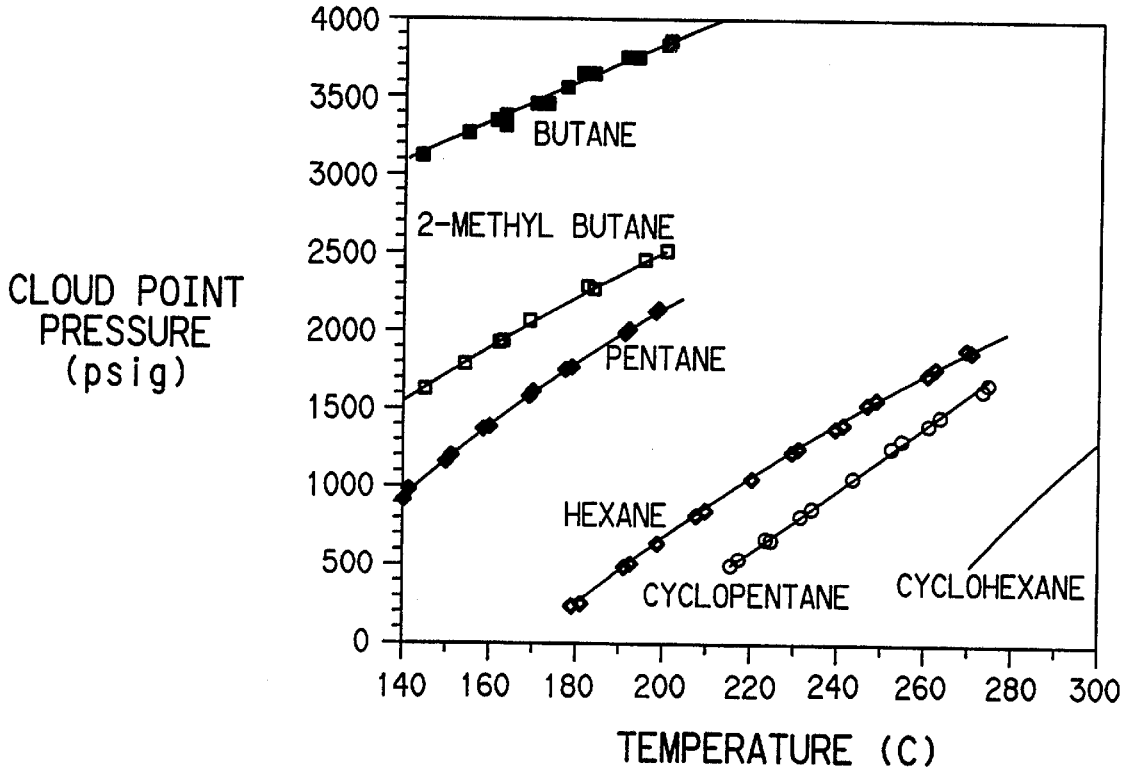
FIG. 7 is a cloud-point pressure curve for 22 weight percent polyethylene in a number of different 100% hydrocarbon spin liquids.
Figure 8:
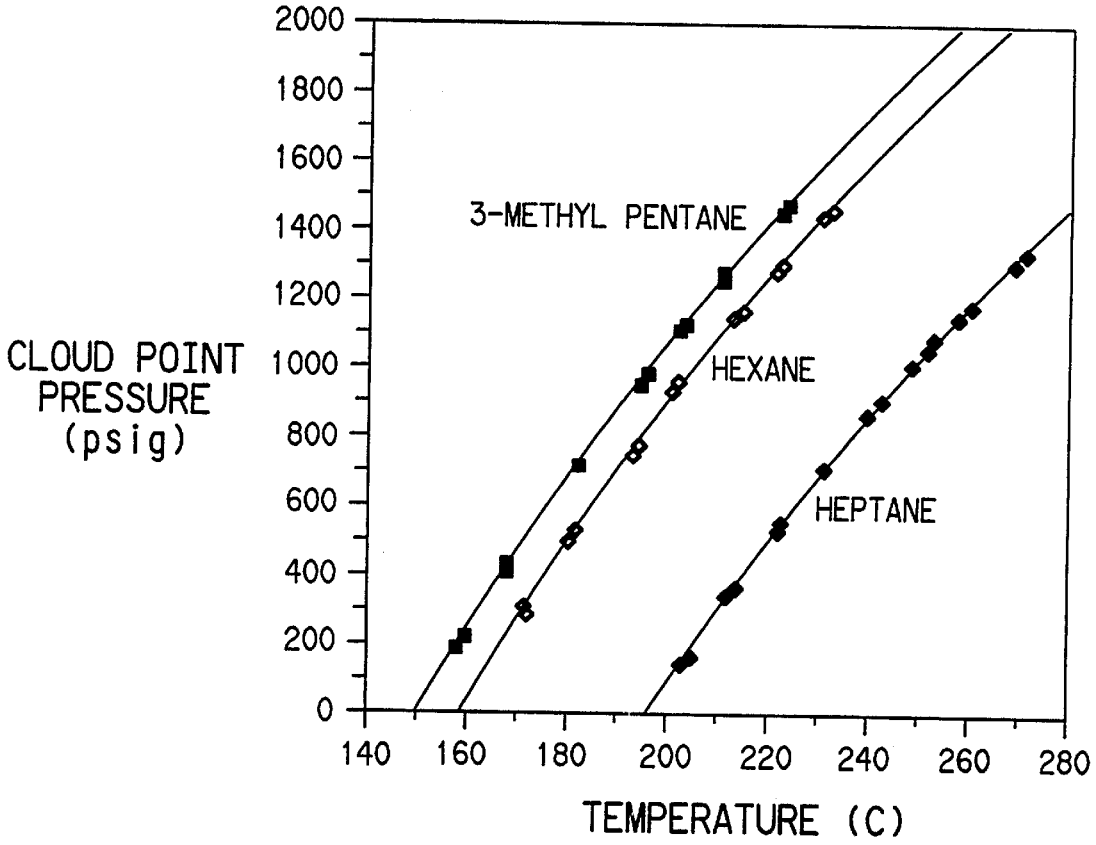
FIG. 8 is a cloud-point pressure curve for 15 weight percent polyethylene in a number of different 100% hydrocarbon spin liquids.
Figure 9:
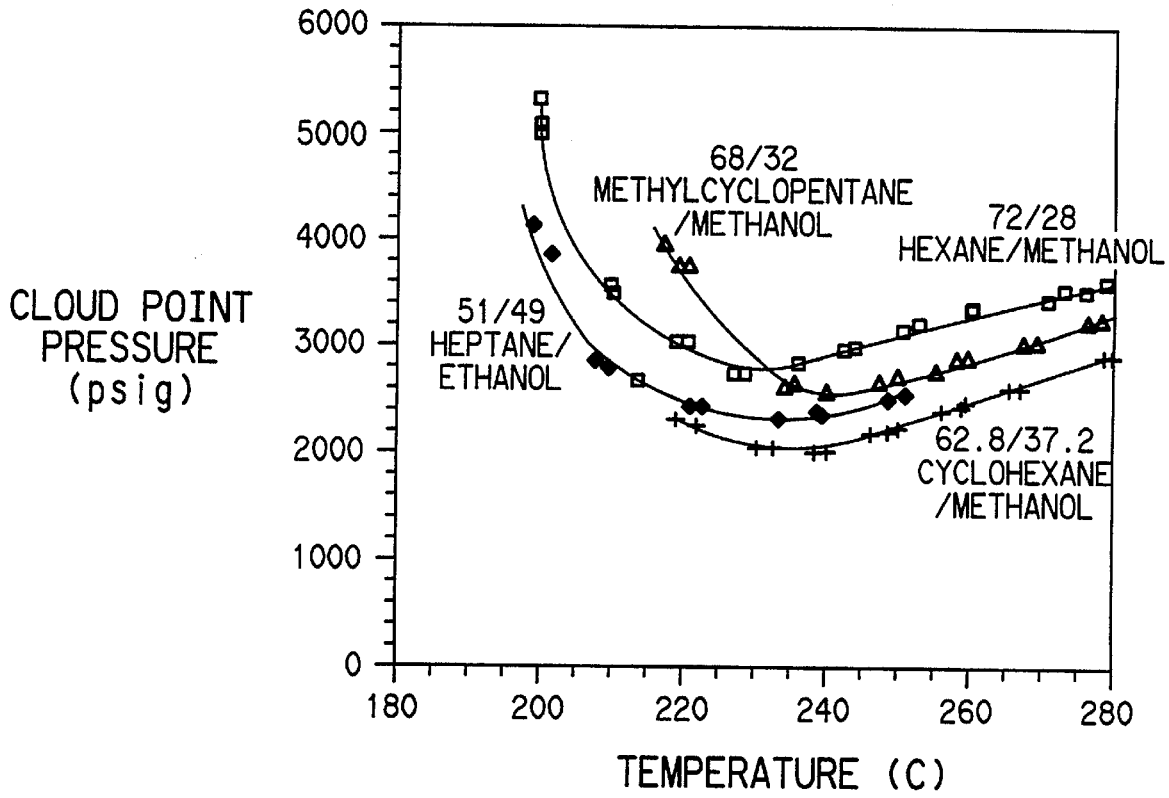
FIG. 9 is a cloud-point pressure curve for 22 weight percent polyethylene in a number of different hydrocarbon/co-solvent spin liquids.
Figure 10:
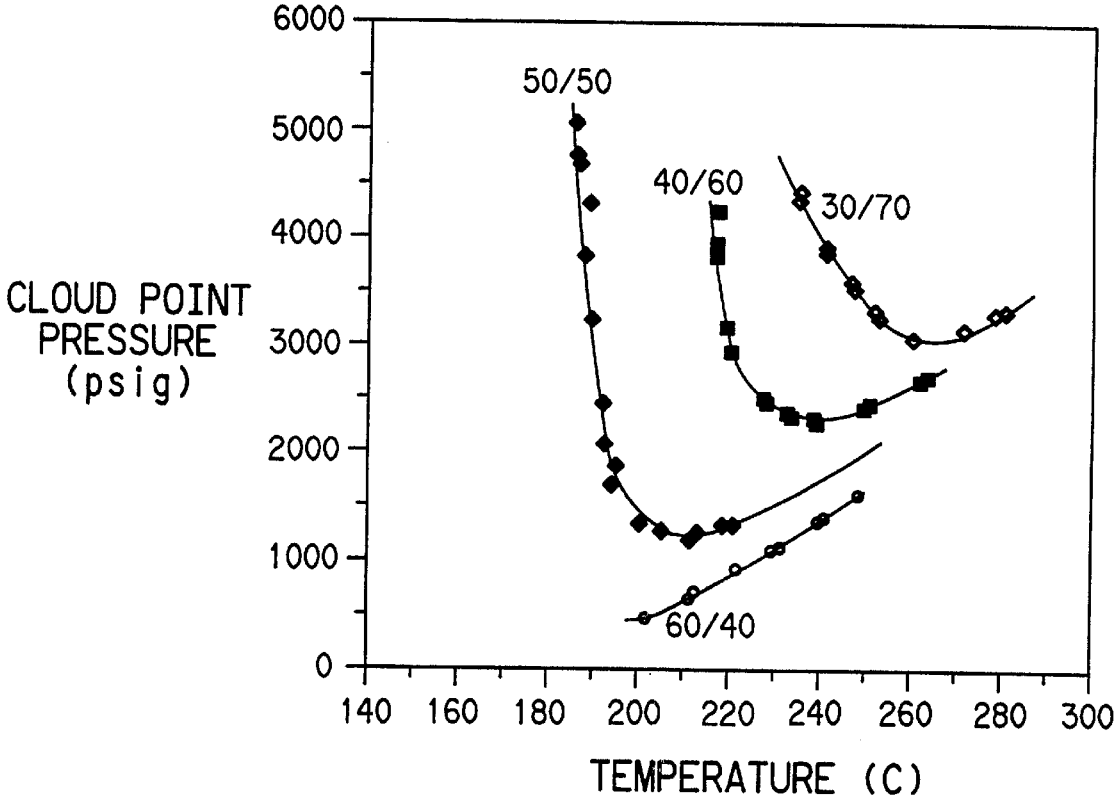
FIG. 10 is a cloud-point pressure curve for 22 weight percent polyethylene in a cyclohexane/ethanol spin liquid.
Figure 11:
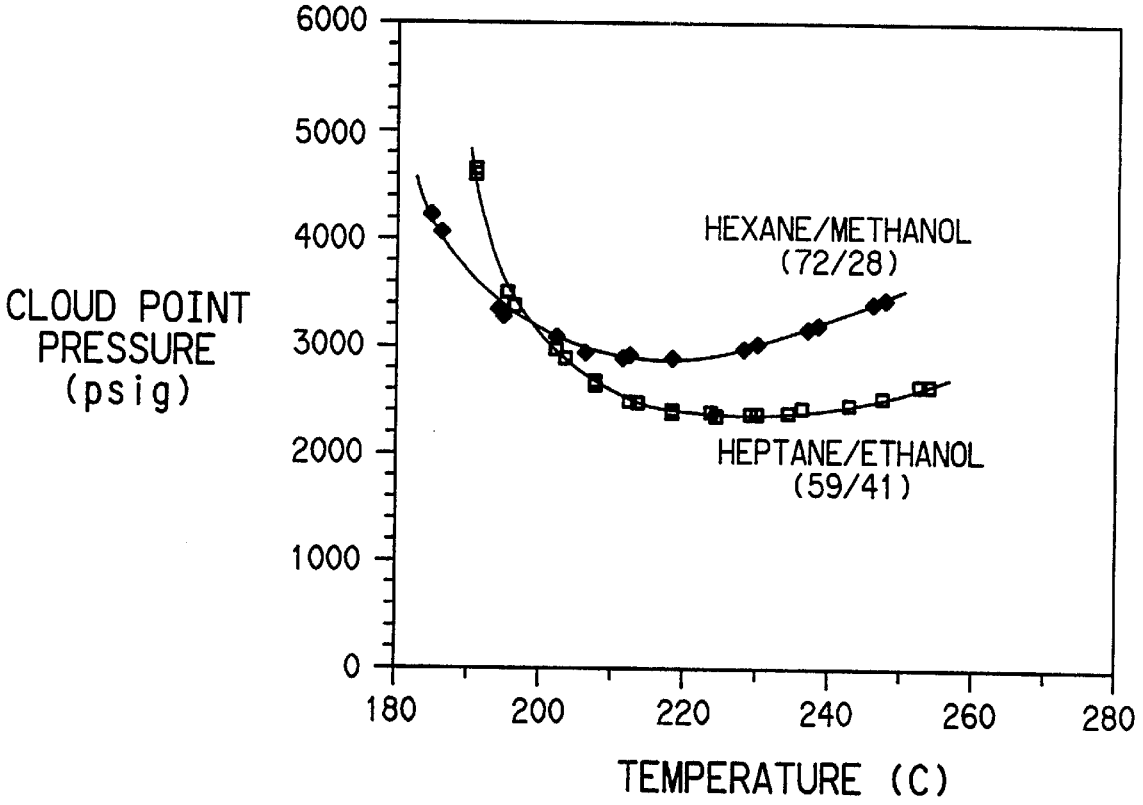
FIG. 11 is a cloud-point pressure curve for 15 weight percent polyethylene in a number of different hydrocarbon/co-solvent azeotropic spin liquids.

FIGS. 1–11 illustrate cloud-point pressure curves for a selected number of 100% hydrocarbon spin liquids and a selected number of hydrocarbon/co-solvent spin liquids in accordance with the invention. The Figures provide the cloud-point pressure for particular spin liquids as a function of spin temperature in degrees C and co-solvent spin liquid concentration in weight percent.

The following Table lists the known normal atmospheric boiling point (Tbp), critical temperature (Tcr), critical pressure (Pcr), heat of vaporization (H of V), density (gm/cc) and molecular weights (NW) for CFC-11 and for several selected co-solvents spin liquids and hydrocarbon spin liquids useful in the invention. In the Table, the parenthetic designation is an abbreviation for the chemical formula of certain well known co-solvent halocarbons (e.g., trichlorofluoromethane=CFC-11).

Spin Liquid Properties

| | Tbp ° C. | Tcr ° C. | Pcr psia | H of V cal/gm | Density gm/cc | MW |
|---|---|---|---|---|---|---|
| (CFC-11) | 23.80 | 198.0 | 639.5 | 43.3 | 1.480 | 137.36 |
| Isobutane | −11.75 | 135.1 | 529.3 | — | 0.557 | 58.12 |
| Butane | −0.45 | 152.1 | 551.0 | 87.5 | 0.600 | 58.12 |
| Cyclobutane | 12.55 | 186.9 | 723.6 | — | 0.694 | 56.10 |
| 2-methyl butane | 27.85 | 187.3 | 491.6 | — | 0.620 | 72.15 |
| 2,2 dimethyl propane | 9.45 | 160.6 | 464.0 | — | 0.591 | 72.15 |
| Pentane | 36.10 | 196.6 | 488.7 | 91.0 | 0.630 | 72.15 |
| Methyl cyclobutane | 39–42 | — | — | — | 0.693 | 70.13 |
| Cyclopentane | 49.25 | 238.6 | 654.0 | — | 0.745 | 70.13 |
| 2,2-dimethyl-butane | 49.65 | 215.7 | 446.6 | — | 0.649 | 86.17 |
| 2,3-dimethyl-butane | 57.95 | 226.9 | 453.9 | — | 0.662 | 86.17 |
| 2-methylpentane | 60.25 | 224.4 | 436.5 | — | 0.653 | 86.17 |
| 3-methylpentane | 63.25 | 231.4 | 452.4 | — | 0.664 | 86.17 |
| Hexane | 68.80 | 234.4 | 436.5 | — | 0.660 | 86.17 |
| Methyl cyclopentane | 71.85 | 259.6 | 548.1 | — | 0.754 | 84.16 |
| Cyclohexane | 80.70 | 280.3 | 590.1 | — | 0.780 | 84.16 |
| 2-methyl hexane | 90.05 | 257.2 | 395.8 | — | 0.679 | 100.20 |
| 3-methyl hexane | 91.85 | 262.1 | 407.4 | — | 0.687 | 100.20 |
| Heptane | 98.50 | 267.2 | 397.3 | — | 0.684 | 100.20 |
| Methanol | 64.60 | 239.5 | 1173 | 263.0 | 0.790 | 32.04 |
| Ethanol | 78.30 | 240.8 | 890.3 | 204.0 | 0.789 | 46.06 |
| Propanol | 97.15 | 263.7 | 749.7 | — | 0.804 | 60.09 |
| Isopropanol | 82.25 | 235.2 | 690.2 | — | 0.786 | 60.09 |
| 2-butanone | 79.55 | 263.7 | 610.5 | — | 0.805 | 72.10 |
| tert-butyl alcohol | 82.35 | 233.1 | 575.7 | — | 0.787 | 74.12 |
| Carbon dioxide | Sub-limes | 31.0 | 1070.1 | — | — | 44.01 |
| (HFC-125) | −48.50 | — | — | — | — | 120.0 |
| (HFC-134a) | −26.50 | 113.3 | 652.0 | 52.4 | 1.190 | — |
| (HFC-152a) | −24.70 | — | — | 78.7 | 0.970 | — |

The following Table lists the weight ratio (Wt. Ratio) and known normal atmospheric boiling point (Tbp) for several selected azeotropes useful in the invention. The data are taken from "Physical and Azeotropic Data" by G. Claxton, National Benzole and Allied Products Association (N.B.A.), 1958.

Azeotropes

| Hydrocarbon Spin Liquid | Co-solvent Spin Liquid | Wt. Ratio | Tbp (° C.) |
|---|---|---|---|
| n-hexane | Methanol | 72/28 | 50.6 |
| n-hexane | Ethanol | 79/21 | 58.7 |
| n-hexane | Isopropanol | 77/23 | 65.7 |
| n-hexane | 2-butanone | 70.5/29.5 | 64.3 |
| n-heptane | Methanol | 48.5/51.5 | 59.1 |
| n-heptane | Ethanol | 51/49 | 70.9 |
| n-heptane | Propanol | 62/38 | 84.8 |
| n-heptane | Isopropanol | 49.5/50.5 | 76.4 |
| Cyclopentane | Methanol | 86/14 | 38.8 |
| Cyclohexane | Methanol | 62.8/37.2 | 54.2 |
| Cyclohexane | Ethanol | 70.8/29.2 | 64.8 |
| Cyclohexane | Propanol | 80/20 | 74.3 |
| Cyclohexane | Isopropanol | 67/33 | 68.6 |
| Cyclohexane | tert-butyl alcohol | 63/37 | 71.5 |
| Cyclohexane | 2-butanone | 69/40 | 71.8 |
| Methyl cyclopentane | Methanol | 68/32 | 51.3 |
| Methyl cyclopentane | Ethanol | 75/25 | 60.3 |
| Methyl cyclopentane | Isopropanol | 75/25 | 63.3 |
| Methyl cyclopentane | tert-butyl alcohol | 74/26 | 66.6 |
| Methyl cyclohexane | Methanol | 46/54 | 59.2 |
| Methyl cyclohexane | Ethanol | 53/47 | 72.1 |
| Methyl cyclohexane | Propanol | 65/35 | 86.3 |
| Methyl cyclohexane | Isopropanol | 47/53 | 77.6 |

In forming a spin mixture of fiber-forming polyolefin in the hydrocarbon/co-solvent spin liquids of the invention, a mixture of the fiber-forming polyolefin and hydrocarbon/co-solvent spin liquid is raised to a mixing/spinning temperature in the range of 130 to 300° C. If polyethylene is the polyolefin and the hydrocarbon spin liquid contains 4 to 5 carbon atoms and has a boiling point below 45° C., the mixing temperature is between 130 to 300° C. and the mixing pressure is greater than 1500 psig, preferably greater than the cloud-point pressure of the spin mixture to be flash-spun. If polyethylene is the polyolefin and the hydrocarbon spin liquid contains 5 to 7 carbon atoms and has a boiling point between 45° C. and 100° C., the mixing temperature is between 130 to 300° C. and the mixing pressure is greater than 700 psig, preferably greater than the cloud-point pressure of the spin mixture to be flash-spun. If polypropylene is used, the mixing temperature is between 150 to 250° C. and the mixing pressure is greater than 700 psig, preferably greater than the cloud-point pressure of the spin mixture to be flash-spun, regardless of the $C_{4-7}$ hydrocarbon/co-solvent spin liquid combination chosen. Mixing pressures less than the cloud-point pressure can be used as long as good mechanical mixing is provided to maintain a fine two phase dispersion (e.g., spin liquid-rich phase dispersed in polyolefin-rich phase). The mixtures described above are held under the required mixing pressure until a solution or a fine dispersion of the fiber-forming polyolefin is formed in the spin liquid. Usually, maximum pressures of less than 10,000 psig are satisfactory. After the fiber-forming polyolefin has dissolved, the pressure may be reduced somewhat and the spin mixture is then flash-spun to form the desired well fibrillated, high tenacity plexifilamentary strand structure.

The concentration of fiber-forming polyolefin in the hydrocarbon/co-solvent spin liquid usually is in the range of 8–35 percent of the total weight of the spin liquid and the fiber-forming polyolefin.

Conventional polyolefin or polymer additives can be incorporated into the spin mixtures by known techniques. These additives can function as ultraviolet-light stabilizers, antioxidants, fillers, dyes, and the like.

The various characteristics and properties mentioned in the preceding discussion and in the Tables and Examples which follow were determined by the following procedures;

Test Methods

The fibrillation level (FIB LEVEL) or quality of the plexifilamentary film-fibril strands produced in the Examples was rated subjectively. A rating of "FINE" indicated that the strand was well fibrillated and similar in quality to those strands produced in the commercial production of spunbonded sheet made from such flash-spun polyethylene strands. A rating of "COARSE" indicated that the strands had an average cross-sectional dimension and/or level of fibrillation that was not as fine as those produced commercially. A rating of "YARN-LIKE" indicated that the strands were relatively coarse and had long tie points which have the appearance of a filament yarn. A rating of "SINTERED" indicated that the strands were partially fused. Sintering occurs whenever the spin liquid used does not have enough quenching power to freeze the strands during spinning. Sintering happens when too high polymer concentrations and/or too high spin temperatures are used for any given spin liquid system. A rating of "SHORT TIE POINT" indicated that the distance between the tie points was shorter than optimum for web opening and subsequent sheet formation.

The surface-area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem Soc., V. 60 p 309–319 (1938) and is reported as $m^2/gm$.

Tenacity of the flash-spun strand is determined with an Instron tensile-testing machine. The strands are conditioned and tested at 70° F. and 65% relative humidity. The sample is then twisted to 10 turns per inch and mounted in the jaws of the Instron Tester. A 1-inch gauge length and an elongation rate of 60% per minute are used. The tenacity (T) at break is recorded in grams per denier (GPD).

The denier (DEN) of the strand is determined from the weight of a 15 cm sample length of strand.

The invention is illustrated in the non-limiting Examples which follow with a batch process in equipment of relatively small size. Such batch processes can be scaled-up and converted to continuous flash-spinning processes that can be performed, for example, in the type of equipment disclosed by Anderson and Romano, U.S. Pat. No. 3,227,794. Parts and percentages are by weight unless otherwise indicated.

EXAMPLES

Description of Apparatus and Operating Procedures

The apparatus used in the following Examples consists of two high pressure cylindrical chambers, each equipped with a piston which is adapted to apply pressure to the contents of the vessel. The cylinders have an inside diameter of 1.0 inch ($2.54\times10^{-2}$m) and each has an internal capacity of 50 cubic centimeters. The cylinders are connected to each other at one end through a 3/32 inch ($2.3\times10^{-3}$m) diameter channel and a mixing chamber containing a series of fine mesh screens used as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch ($6.3\times10^{-3}$m) diameter and about 2.0 inch ($5.08\times10^{-2}$m ) length, and a spinneret orifice of 0.030 inch ($7.62\times10^{-4}$m) diameter and 0.030 inches length. The pistons are driven by high pressure water supplied by a hydraulic system.

In operation, the apparatus is charged with polyethylene or polypropylene pellets and spin liquids at a differential pressure of about 50 psi (345 kPa) or higher, and high pressure water, e.g. 1800 psi (12410 kPa) is introduced to drive the piston to compress the charge. The contents then are heated to mixing temperature and held at that temperature for about an hour or longer during which time a differential pressure of about 50 psi (345 kPa) is alternatively established between the two cylinders to repeatedly force the contents through the mixing channel from one cylinder to the other to provide mixing and effect formation of a spin mixture. The spin mixture temperature is then raised to the final spin temperature, and held there for about 15 minutes to equilibrate the temperature. Mixing is continued throughout this period. The pressure letdown chambers as disclosed in Anderson et al., were not used in these spinning Examples. Instead, the accumulator pressure was set to that desired for spinning at the end of the mixing cycle to simulate the letdown chamber effect. Next, the valve between the spin cell and the accumulator is opened, and then the spinneret orifice is opened immediately thereafter in rapid succession. It usually takes about two to five seconds to open the spinneret orifice after opening the valve between the spin cell and the accumulator. This should correspond to the residence time in the letdown chamber. When letdown chambers are used, the residence time in the chamber is usually 0.2 to 0.8 seconds. However, it has been determined that residence time does not have too much effect on fiber morphology and/or properties as long as it is greater than about 0.1 second but less than about 30 seconds. The resultant flash-spun product is collected in a stainless steel open mesh screen basket. The pressure recorded just before the spinneret using a computer during spinning is entered as the spin pressure.

The morphology of plexifilamentary strands obtained by this process is greatly influenced by the level of pressure used for spinning. When the spin pressure is much greater than the cloud-point pressure of the spin mixture, "yarn-like" strands are usually obtained. Conversely, as the spin pressure is gradually decreased, the average distance between the tie points becomes very short while the strands become progressively finer. When the spin pressure approaches the cloud-point pressure of the spin mixture, very fine strands are obtained, but the distance between the tie points become very short and the resultant product looks somewhat like a porous membrane. As the spin pressure is further reduced below the cloud-point pressure, the distance between the tie points starts to become longer. Well fibrillated plexifilaments, which are most suitable for sheet formation, are usually obtained when spin pressures slightly below the cloud point pressure are used. The use of pressures which are too much lower than the cloud-point pressure of the spin mixture generally leads to a relatively coarse plexifilamentary structure. The effect of spin pressure on fiber morphology also depends somewhat on the type of the polymer/spin liquid system to be spun. In some cases, well fibrillated plexifilaments can be obtained even at spin pressures slightly higher than the cloud-point pressure of the spin mixture. Therefore, the effect of spin pressure discussed herein is intended merely as a guide in selecting the initial spinning conditions to be used and not as a general rule.

For cloud-point pressure determination, the spinneret assembly is replaced with a view cell assembly containing a ½ inch ($1.23\times10^{-2}$m) diameter high pressure sight glass, through which the contents of the cell can be viewed as they flow through the channel. The window was lighted by means of a fiber optic light guide, while the content at the window itself was displayed on a television screen through a closed circuit television camera. A pressure measuring device and a temperature measuring device located in close proximity to the window provided the pressure and temperature details of the content at the window respectively. The temperature and pressure of the contents at the window were continuously monitored by a computer. When a clear, homogeneous polymer-spin liquid mixture was established after a period of mixing, the temperature was held constant, and the differential pressure applied to the pistons was reduced to 0 psi (0 kPa), so that the pistons stopped moving. Then the pressure applied to the contents was gradually decreased until a second phase formed in the contents at the window. This second phase can be observed through the window in the form of cloudiness of the once clear, homogeneous polymer-spin liquid mixture. At the inception of this cloudiness in the content, the pressure and temperature as measured by the respective measuring devices near the window were recorded by the computer. This pressure is the phase separation pressure or the cloud-point pressure at that temperature for that polymer-spin liquid mixture. Once these data are recorded, mixing was again resumed, while the content was heated to the temperature where the next phase separation pressure has to be measured. As noted above, cloud-point pressures for selected polyolefin/spin liquid spin mixtures are plotted in FIGS. 1–11 at varying co-solvent spin liquid concentrations and spin temperatures.

The following Tables set forth the particular parameters tested and the samples used;

Table 1: Control runs—Polyethylene spun from 100% pentane.

Table 2: Polyethylene spun from pentane mixed with different co-solvents spin liquids (e.g., $CO_2$, methanol, ethanol, HFC-134a).

Table 3: Polyethylene spun at high polymer concentrations (i.e. 30 and 35 wt.% polyethylene). This Table shows that polyethylene can be spun at a higher polymer concentration by using a co-solvent spin liquid.

Table 4: Polypropylene fibers spun from 100% pentane.

Table 5: Control runs—Polyethylene spun from various 100% hydrocarbon spin liquids (e.g., cyclohexane, cyclopentane, heptane, hexane, methyl cyclopentane).

Table 6: Polyethylene spun from various hydrocarbon spin liquids mixed with different co-solvent spin liquids (e.g., methanol, ethanol).

In the Tables, PE 7026A refers to a high density polyethylene called Alathon 7026A commercially available from Occidential Chemical Corporation of Houston, Texas. PP 6823 refers to a high molecular weight polypropylene called Profax 6823 commercially available from Himont, Inc. of Wilmington, Del.

In the Tables, MIX T stands for mixing temperature in degrees C, MIX P stands for mixing pressure in psig, SPIN T stands for spinning temperature in degrees C, SPIN p stands for spinning pressure in psig, T(GPD) stands for tenacity in grams per denier as measured at 1 inch ($2.54\times10^{-2}$m) gauge length 10 turns per inch ($2.54\times10^{-2}$m) and SA ($M^2$/GM) stands for surface area in square meters per gram. CONC stands for the weight percent of polyolefin based on the total amount of polyolefin and spin liquid present. SOLVENT stands for the hydrocarbon spin liquid. CO-SOLVENT stands for the co-solvent spin liquid added and its weight percent based on the total amount of co-solvent spin liquid and hydrocarbon spin liquid present.

TABLE 1

POLYETHYLENE FIBERS SPUN FROM 100% PENTANE

| | SAMPLE NO | | |
|---|---|---|---|
| | 1<br>P10981-42 | 2<br>P10981-132 | 3<br>P10981-40 |
| POLYMER | PE 7026A | PE7026A | PE 7026A |
| CONC (WGT %) | 22 | 22 | 22 |
| SOLVENT | PENTANE | PENTANE | PENTANE |
| CO-SOLVENT | NONE | NONE | NONE |
| MIX T (C) | 180 | 180 | 180 |
| MIX P (PSIG) | 5500 | 5500 | 2500 |
| SPIN T (C) | 180 | 180 | 180 |
| SPIN P (PSIG) | 3800 | 2250 | 1500 |
| DEN | 1035 | 499 | 398 |
| T (GPD) | 1.93 | 2.46 | 3.4 |
| E (%) | | | |
| FIB LEVEL | YARN-LIKE | YARN-LIKE | FINE |
| SA ($M^2$/GM) | | | |

| | SAMPLE NO | | |
|---|---|---|---|
| | 4<br>P11030-26 | 5<br>P10981-114 | 6<br>P11030-100 |
| POLYMER | PE 7026A | PE 7026A | PE 7026A |
| CONC (WGT %) | 22 | 22 | 22 |
| SOLVENT | PENTANE | PENTANE | PENTANE |
| CO-SOLVENT | NONE | NONE | NONE |
| MIX T (C) | 180 | 180 | 180 |
| MIX P (PSIG) | 5500 | 5500 | 5500 |
| SPIN T (C) | 180 | 180 | 180 |
| SPIN P (PSIG) | ~1300 | 1300 | 1200 |
| DEN | 355 | 395 | 330 |
| T (GPD) | 3.97 | 2.39 | 2.99 |
| E (%) | 122 | | 103 |
| FIB LEVEL | FINE | FINE | FINE |
| SA ($M^2$/GM) | | | |

| | SAMPLE NO | | |
|---|---|---|---|
| | 7<br>P10981-16 | 8<br>P11030-22 | 9<br>P11030-16 |
| POLYMER | PE 7026A | PE 7026A | PE 7026A |
| CONC (WGT %) | 22 | 22 | 22 |
| SOLVENT | PENTANE | PENTANE | PENTANE |
| CO-SOLVENT | NONE | NONE | NONE |
| MIX T (C) | 180 | 195 | 195 |
| MIX P (PSIG) | 2500 | 5500 | 5500 |
| SPIN T (C) | 180 | 195 | 195 |
| SPIN P (PSIG) | 1100 | ~3300 | 1200 |
| DEN | 450 | 440 | 309 |
| T (GPD) | 2.54 | 2.95 | 3.95 |
| E (%) | | | 121 |
| FIB LEVEL | FINE | YARN-LIKE | FINE |
| SA ($M^2$/GM) | | | |

| | SAMPLE NO<br>11<br>P10891-144 |
|---|---|
| POLYMER | PE 7026A |
| CONC (WGT %) | 22 |
| SOLVENT | PENTANE |
| CO-SOLVENT | NONE |
| MIX T (C) | 210 |
| MIX P (PSIG) | 5500 |
| SPIN T (C) | 210 |
| SPIN P (PSIG) | 2000 |
| DEN | 361 |
| T (GPD) | 2.04 |
| E (%) | 64 |
| FIB LEVEL | SLIGHTLY COARSE |
| SA ($M^2$/GM) | |

TABLE 2

POLYETHYLENE SPUN FROM VARIOUS PENTANE BASED MIXED SPIN LIQUIDS

| | SAMPLE NO | | |
|---|---|---|---|
| | 1<br>P11046-112 | 2<br>P11046-118 | 3<br>P11046-120 |
| POLYMER | PE 7026A | PE 7026A | PE 7026A |
| CONC (WGT %) | 22 | 22 | 22 |
| SOLVENT | PENTANE | PENTANE | PENTANE |
| CO-SOLVENT | METHANOL<br>(12.5% BY WGT) | METHANOL<br>(25% BY WGT) | METHANOL<br>(25% BY WGT |
| MIX T (C) | 210 | 210 | 210 |
| MIX P (PSIG) | 4500 | 5000 | 5000 |
| SPIN T (C) | 210 | 210 | 210 |
| SPIN P (PSIG) | 1950 | 2620 | 2500 |
| DEN | 294 | 339 | 310 |
| T (GPD) | 4.14 | 4.74 | 5.06 |
| E (%) | 65 | 70 | 67 |
| FIB LEVEL | FINE | FINE | FINE |
| SA ($M^2$/GM) | | 32.9 | 25.1 |

| | SAMPLE NO | | |
|---|---|---|---|
| | 4<br>P11046-128 | 5<br>P11046-132 | 6<br>P11046-130 |
| POLYMER | PE 7026A | PE 7026A | PE 7026A |
| CONC (WGT %) | 22 | 22 | 22 |
| SOLVENT | PENTANE | PENTANE | PENTANE |
| CO-SOLVENT | METHANOL<br>(30 WGT %) | METHANOL<br>(30 WGT %) | METHANOL<br>(30 WGT.%) |
| MIX T (C) | 210 | 210 | 210 |
| MIX P (PSIG) | 5000 | 5000 | 5000 |
| SPIN T (C) | 210 | 210 | 210 |
| SPIN P (PSIG) | ~3100 | 2900 | 2650 |
| DEN | 335 | 325 | 343 |
| T (GPD) | 4.3 | 5.25 | 4.13 |
| E (%) | 53 | 71 | 65 |
| FIB LEVEL | VERY FINE | FINE | SLIGHTLY COARSE |
| SA ($M^2$/GM) | 41.2 | 32.8 | 21.4 |

| | SAMPLE NO | | |
|---|---|---|---|
| | 7<br>P10973-76 | 8<br>P10973-73 | 9<br>P10973-74 |
| POLYMER | PE 7026A | PE 7026A | PE 7026A |
| CONC (WGT %) | 22 | 22 | 22 |
| SOLVENT | PENTANE | PENTANE | PENTANE |
| CO-SOLVENT | CO2<br>(10 WGT %) | CO2<br>(10 WGT %) | CO2<br>(10 WGT %) |
| MIX T (C) | 180 | 180 | 180 |
| MIX P (PSIG) | 5000 | 5000 | 5000 |
| SPIN T (C) | 180 | 180 | 180 |
| SPIN P (PSIG) | 2940 | 2800 | 2620 |
| DEN | 342 | 414 | 338 |
| T (GPD) | 5.47 | 4.6 | 5.47 |
| E (%) | 88 | 85 | 88 |
| FIB LEVEL | FINE | FINE | FINE |
| SA ($M^2$/GM) | | | |

| | SAMPLE NO | | |
|---|---|---|---|
| | 10<br>P11030-44 | 11<br>P11030-42 | 12<br>P11030-48 |
| POLYMER | PE 7026A | PE 7026A | PE 7026A |
| CONC (WGT %) | ~24 | 22 | 22 |
| SOLVENT | PENTANE | PENTANE | PENTANE |
| CO-SOLVENT | ETHANOL<br>(~40 WGT %) | ETHANOL<br>(40 WGT %) | ETHANOL<br>(40 WGT %) |
| MIX T (C) | 195 | 195 | 210 |
| MIX P (PSIG) | 5500 | 5500 | 5500 |
| SPIN T (C) | 195 | 195 | 210 |
| SPIN P (PSIG) | 1700 | 2100 | 2150 |
| DEN | 358 | 348 | 320 |
| T (GPD) | 4.48 | 4.09 | 4.77 |

TABLE 2-continued

| POLYETHYLENE SPUN FROM VARIOUS PENTANE BASED MIXED SPIN LIQUIDS | | | |
|---|---|---|---|
| E (%) | 116 | 120 | 104 |
| FIB LEVEL | FINE/SHORT TIE POINT | FINE/SHORT TIE POINT | FINE/SHORT TIE POINT |
| SA ($M^2$/GM) | | | |

| | SAMPLE NO | |
|---|---|---|
| | 13 P10973-103 | 14 P10973-101 |
| POLYMER | PE 7026A | PE 7026A |
| CONC (WGT %) | 22 | 22 |
| SOLVENT | PENTANE | PENTANE |
| CO-SOLVENT | HFC-134a (17.5 WGT %) | HFC-134a (17.5 WGT %) |
| MIX T (C) | 180 | 180 |
| MIX P (PSIG) | 3800 | 3800 |
| SPIN T (C) | 180 | 180 |
| SPIN P (PSIG) | 2930 | 2750 |
| DEN | 370 | 378 |
| T (GPD) | 4.55 | 4.43 |
| E (%) | 87 | 87 |
| FIB LEVEL | FINE | FINE |
| SA ($M^2$/GM) | | |

TABLE 3

| POLYETHYLENE SPUN AT HIGH POLYMER CONCENTRATIONS | SAMPLE NO | | |
|---|---|---|---|
| | 1 P10981-58 | 2 P10981-62 | 3 P10981-66 |
| POLYMER | PE 7026A | PE 7026A | PE 7026A |
| CONC (WGT %) | 30 | 35 | 35 |
| SOLVENT | PENTANE | PENTANE | PENTANE |
| CO-SOLVENT | METHANOL (30 WGT %) | METHANOL (40 WGT %) | METHANOL (40 WGT %) |
| MIX T (C) | 180 | 210 | 210 |
| MIX P (PSIG) | 5500 | 5500 | 5500 |
| SPIN T (C) | 180 | 210 | 210 |
| SPIN P (PSIG) | 3750 | 3700 | 2600 |
| DEN | 788 | 884 | 725 |
| T (GPD) | 3.38 | 2.49 | 2.86 |
| E (%) | | | |
| FIB LEVEL | FINE | FINE | FINE |

| | SAMPLE NO | | |
|---|---|---|---|
| | 4 P11085-10 | 5 P11085-28 | 6 P11085-32 |
| POLYMER | PE 7026A | PE 7026A | PE 7026A |
| CONC (WGT %) | 30 | 30 | 35 |
| SOLVENT | PENTANE | PENTANE | PENTANE |
| CO-SOLVENT | NONE | NONE | NONE |
| MIX T (C) | 180 | 180 | 210 |
| MIX P (PSIG) | 5000 | 5000 | 5000 |

TABLE 3-continued

| POLYETHYLENE SPUN AT HIGH POLYMER CONCENTRATIONS | | | |
|---|---|---|---|
| SPIN T (C) | 180 | 180 | 210 |
| SPIN P (PSIG) | 3200 | 1075 | ~3200 |
| DEN | | | |
| T (GPD) | | | |
| E (%) | | | |
| FIB LEVEL | VERY COARSE | COARSE/FOAMY | FOAM |

| | SAMPLE NO 7 P11085-30 |
|---|---|
| POLYMER | PE 7026A |
| CONC (WGT %) | 35 |
| SOLVENT | PENTANE |
| CO-SOLVENT | NONE |
| MIX T (C) | 210 |
| MIX P (PSIG) | 5000 |
| SPIN T (C) | 210 |
| SPIN P (PSIG) | 1150 |
| DEN | |
| T (GPD) | |
| E (%) | |
| FIB LEVEL | FOAM |

As can be seen from Table 3, when alcohols are used as a co-solvent spin liquid, higher polyolefin concentrations can be flash-spun without sintering the fiber strands than is possible with the hydrocarbon spin liquid alone. This is apparently due to the higher heat of vaporization and the resultant higher cooling power of the alcohols.

TABLE 4

| POLYPROPYLENE SPUN FROM 100% PENTANE | | | |
|---|---|---|---|
| | SAMPLE NO | | |
| | 1<br>P11030-78 | 2<br>P11030-80 | 3<br>P11030-84 |
| POLYMER | PP 6823 | PP 6823 | PP 6823 |
| CONC (WGT %) | 14 | 14 | 14 |
| SOLVENT | PENTANE | PENTANE | PENTANE |
| CO-SOLVENT | NONE | NONE | NONE |
| MIX T (C) | 189 | 180 | 180 |
| MIX P (PSIG) | 4000 | 4000 | 4000 |
| SPIN T (C) | 200 | 200 | 210 |
| SPIN P (PSIG) | 1750 | 1350 | 1200 |
| DEN | 273 | 164 | 146 |
| T (GPD) | 0.35 | 0.54 | 1.01 |
| E (%) | 75 | 79 | 105 |
| FIB LEVEL | SLIGHTLY COARSE | SLIGHTLY COARSE | FINE |

| | SAMPLE NO<br>4<br>P11030-56 |
|---|---|
| POLYMER | PP 6823 |
| CONC (WGT %) | 14 |
| SOLVENT | PENTANE |
| CO-SOLVENT | NONE |
| MIX T (C) | 180 |
| MIX P (PSIG) | 4000 |
| SPIN T (C) | 210 |
| SPIN P (PSIG) | 1000 |
| DEN | 196 |
| T (GPD) | 0.51 |
| E (%) | 86 |
| FIB LEVEL | FINE |

TABLE 5

| POLYETHYLENE SPUN FROM VARIOUS 100% HYDROCARBON SPIN LIQUIDS | | | |
|---|---|---|---|
| | SAMPLE NO | | |
| | 1<br>P11085-102 | 2<br>P11085-78 | 3<br>P11085-82 |
| POLYMER | PE 7026A | PE 7026A | PE 7026A |
| CONC (WGT %) | 15 | 22 | 22 |
| SOLVENT | CYCLOHEXANE | CYCLOHEXANE | CYCLOPENTANE |
| CO-SOLVENT | NONE | NONE | NONE |
| MIX T (C) | 230 | 230 | 230 |
| MIX P (PSIG) | 4500 | 3000 | 3000 |
| SPIN T (C) | 230 | 230 | 230 |
| SPIN P (PSIG) | 800 | 675 | 750 |
| DEN | 362 | | |
| T (GPD) | 0.365 | | |
| E (%) | 395 | | |
| FIB LEVEL | FOAMY/COARSE | FOAMY/ PARTIALLY SINTERED | VERY COARSE |
| SA ($M^2$/ GM) | | | |

| | SAMPLE NO | | |
|---|---|---|---|
| | 4<br>P11085-84 | 5<br>P11085-100 | 6<br>P11085-98 |
| POLYMER | PE 7026A | PE 7026A | PE 7026A |
| CONC (WGT %) | 22 | 15 | 15 |
| SOLVENT | CYCLOPENTANE | HEPTANE | HEPTANE |
| CO-SOLVENT | NONE | NONE | NONE |
| MIX T (C) | 200 | 230 | 230 |
| MIX P (PSIG) | 3000 | 4500 | 4500 |
| SPIN T (C) | 250 | 230 | 230 |
| SPIN P (PSIG) | 950 | 2050 | 870 |

TABLE 5-continued

| POLYETHYLENE SPUN FROM VARIOUS 100% HYDROCARBON SPIN LIQUIDS | | | |
|---|---|---|---|
| DEN | | 564 | 396 |
| T (GPD) | | 0.773 | 0.691 |
| E (%) | | 192 | 195 |
| FIB LEVEL | VERY COARSE/ SEVERELY SINTERED | FOAMY/COARSE | FOAMY/COARSE |
| SA ($M^2$/GM) | | | |

| | SAMPLE NO | | |
|---|---|---|---|
| | 7 P11085-80 | 8 P11085-96 | 9 P11085-94 |
| POLYMER | PE 7026A | PE 7026A | PE 7026A |
| CONC (WGT %) | 22 | 15 | 15 |
| SOLVENT | HEPTANE | HEXANE | HEXANE |
| CO-SOLVENT | NONE | NONE | NONE |
| MIX T (C) | 230 | 230 | 230 |
| MIX P (PSIG) | 3000 | 4500 | 4500 |
| SPIN T (C) | 230 | 230 | 230 |
| SPIN P (PSIG) | 700 | 2700 | 950 |
| DEN | | 695 | 212 |
| T (GPD) | | 0.894 | 2.29 |
| E (%) | | 90 | 66 |
| FIB LEVEL | COARSE/SINTERED | VERY COARSE | FINE |
| SA ($M^2$/GM) | | | |

| | SAMPLE NO | | |
|---|---|---|---|
| | 10 P11085-76 | 11 P11085-56 | 12 P11085-60 |
| POLYMER | PE 7026A | PE 7026A | PE 7026A |
| CONC (WGT %) | 22 | 22 | 22 |
| SOLVENT | HEXANE | METHYL-CYCLOPENTANE | METHYL-CYCLOPENTANE |
| CO-SOLVENT | NONE | NONE | NONE |
| MIX T (C) | 230 | 240 | 240 |
| MIX P (PSIG) | 3000 | 3000 | 3000 |
| SPIN T (C) | 230 | 240 | 240 |
| SPIN P (PSIG) | 850 | 1450 | 730 |
| DEN | 1096 | | |
| T (GPD) | 0.348 | | |
| E (%) | 92 | | |
| FIB LEVEL | COARSE/ SINTERED | SINTERED | SINTERED |
| SA ($M^2$/GM) | | | |

TABLE 6

| POLYETHYLENE SPUN FROM VARIOUS HYDROCARBON BASED MIXED SPIN LIQUIDS | | | |
|---|---|---|---|
| | SAMPLE NO | | |
| | 1 P11046-76 | 2 P11046-74 | 3 P11046-78 |
| POLYMER | PE 7026A | PE 7026A | PE 7026A |
| CONC (WGT %) | 15 | 15 | 18.5 |
| SOLVENT | CYCLOHEXANE | CYCLOHEXANE | CYCLOHEXANE |
| CO-SOLVENT | METHANOL (37.2% BY WGT) | METHANOL (37.2% BY WGT) | METHANOL (37.2% BY WGT) |
| MIX T (C) | 230 | 230 | 230 |
| MIX P (PSIG) | 3000 | 3000 | 3500 |
| SPIN T (C) | 230 | 260 | 230 |
| SPIN P (PSIG) | 1750 | ~1700 | 1770 |
| DEN | 188 | 186 | 247 |
| T (GPD) | 4.74 | 2.12 | 4.69 |
| E (%) | 73 | 42 | 88 |
| FIB LEVEL | VERY FINE | FINE | VERY FINE |
| SA ($M^2$/GM) | | | |
| COMMENTS | AZEOTROPE | AZEOTROPE | AZEOTROPE |

TABLE 6-continued

POLYETHYLENE SPUN FROM VARIOUS HYDROCARBON BASED MIXED SPIN LIQUIDS

| | SAMPLE NO | | |
|---|---|---|---|
| | 4<br>P11046-66 | 5<br>P11046-70 | 6<br>P11046-20 |
| POLYMER | PE 7026A | PE 7026A | PE 7026A |
| CONC (WGT %) | 22 | 22 | 22 |
| SOLVENT | CYCLOHEXANE | CYCLOHEXANE | CYCLOHEXANE |
| CO-SOLVENT | METHANOL<br>(37.2% BY WGT) | METHANOL<br>(37.2% BY WGT) | ETHANOL<br>(60 WGT %) |
| MIX T (C) | 230 | 230 | 240 |
| MIX P (PSIG) | 3000 | 3000 | 3250 |
| SPIN T (C) | 230 | 230 | 240 |
| SPIN P (PSIG) | 1700 | 1100 | 1625 |
| DEN | 337 | 283 | 223 |
| T (GPD) | 3.35 | 4.48 | 2.77 |
| E (%) | 78 | 74 | 118 |
| FIB LEVEL | SHORT TIE POINT | SHORT TIE POINT | FINE |
| SA ($M^2$/GM) | | | |
| COMMENTS | AZEOTROPE | AZEOTROPE | NONAZEOTROPE |

| | SAMPLE NO | | |
|---|---|---|---|
| | 7<br>P11087-21 | 8<br>P11087-22 | 9<br>P11046-86 |
| POLYMER | PE 7026A | PE 7026A | PE 7026A |
| CONC (WGT %) | 22 | 22 | 15 |
| SOLVENT | CYCLOHEXANE | CYCLOHEXANE | HEPTANE |
| CO-SOLVENT | ETHANOL<br>(60 WGT %) | ETHANOL<br>(60 WGT %) | ETHANOL<br>(49% BY WGT) |
| MIX T (C) | 240 | 240 | 230 |
| MIX P (PSIG) | 3100 | 3300 | 4500 |
| SPIN T (C) | 240 | 240 | 230 |
| SPIN P (PSIG) | 1420 | 1280 | 2200 |
| DEN | 242 | 206 | 224 |
| T (GPD) | 4.921 | 3.84 | 2.58 |
| E (%) | 84 | 91 | 64 |
| FIB LEVEL | FINE | FINE | VERY FINE |
| SA ($M^2$/GM) | | | |
| COMMENTS | NONAZEOTROPE | NONAZEOTROPE | AZEOTROPE |

| | SAMPLE NO | | |
|---|---|---|---|
| | 10<br>P11085-66 | 11<br>P11085-74 | 12<br>P11085-68 |
| POLYMER | PE 7026A | PE 7026A | PE 7026A |
| CONC (WGT %) | 15 | 15 | 15 |
| SOLVENT | HEPTANE | HEPTANE | HEPTANE |
| CO-SOLVENT | ETHANOL<br>(49 WGT %) | ETHANOL<br>(49 WGT %) | ETHANOL<br>(49 WGT %) |
| MIX T (C) | 230 | 230 | 230 |
| MIX P (PSIG) | 4500 | 4500 | 4500 |
| SPIN T (C) | 230 | 230 | 230 |
| SPIN P (PSIG) | 2150 | 2100 | 2000 |
| DEN | 226 | 272 | 248 |
| T (GPD) | 3.69 | 3.33 | 2.94 |
| E (%) | 77 | 103 | 87 |
| FIB LEVEL | FINE | FINE | FINE |
| SA ($M^2$/GM) | | | |
| COMMENTS | AZEOTROPE | AZEOTROPE | AZEOTROPE |

| | SAMPLE NO | | |
|---|---|---|---|
| | 13<br>11046-82 | 14<br>P11046-88 | 15<br>P11046-84 |
| POLYMER | PE 7026A | PE 7026A | PE 7026A |
| CONC (WGT %) | 15 | 15 | 15 |
| SOLVENT | HEPTANE | HEXANE | HEXANE |
| CO-SOLVENT | ETHANOL<br>(49% BY WGT) | METHANOL<br>(28% BY WGT) | METHANOL<br>(28% BY WGT) |
| MIX T (C) | 230 | 230 | 230 |
| MIX P (PSIG) | 3500 | 4500 | 4500 |
| SPIN T (C) | 230 | 230 | 230 |
| SPIN P (PSIG) | 1500 | ~2700 | 2250 |

TABLE 6-continued

| POLYETHYLENE SPUN FROM VARIOUS HYDROCARBON BASED MIXED SPIN LIQUIDS | | | |
|---|---|---|---|
| DEN | 233 | 228 | 194 |
| T (GPD) | 3.51 | 3.54 | 4.86 |
| E (%) | 79 | 59 | 63 |
| FIB LEVEL | FINE | VERY FINE | FINE |
| SA ($M^2$/GM) | | | |
| COMMENTS | AZEOTROPE | AZEOTROPE | AZEOTROPE |

| | SAMPLE NO | | |
|---|---|---|---|
| | 16 P11085-38 | 17 P11085-54 | 18 P11085-50 |
| POLYMER | PE 7026A | PE 7026A | PE 7026A |
| CONC (WGT %) | 22 | 22 | 22 |
| SOLVENT | METHYL-CYCLOPENTANE | METHYL-CYCLOPENTANE | METHYL-CYCLOPENTANE |
| CO-SOLVENT | METHANOL (32 WGT %) | METHANOL (32 WGT %) | METHANOL (32 WGT %) |
| MIX T (C) | 240 | 240 | 240 |
| MIX P (PSIG) | 4500 | 2000 | 4500 |
| SPIN T (C) | 240 | 240 | 240 |
| SPIN P (PSIG) | 1800 | 1750 | 1600 |
| DEN | 316 | 297 | 313 |
| T (GPD) | 4.08 | 3.68 | 4.26 |
| E (%) | 67 | 64 | 69 |
| FIB LEVEL | SHORT TIE POINT | FINE | FINE |
| SA ($M^2$/GM) | | | |
| COMMENTS | AZEOTROPE | AZEOTROPE | AZEOTROPE |

| | SAMPLE NO | |
|---|---|---|
| | 19 P11085-52 | 20 P11085-40 |
| POLYMER | PE 7026A | PE 7026A |
| CONC (WGT %) | 22 | 22 |
| SOLVENT | METHYL-CYCLOPENTANE | METHYL-CYCLOPENTANE |
| CO-SOLVENT | METHANOL (32 WGT %) | METHANOL (32 WGT %) |
| MIX T (C) | 240 | 240 |
| MIX P (PSIG) | 1800 | 4500 |
| SPIN T (C) | 240 | 240 |
| SPIN P (PSIG) | 1600 | 1470 |
| DEN | 276 | 271 |
| T (GPD) | 3.31 | 4.44 |
| E (%) | 70 | 74 |
| FIB LEVEL | FINE | FINE |
| SA ($M^2$/GM) | | |
| COMMENTS | AZEOTROPE | AZEOTROPE |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. An improved single phase liquid spin solution for flash-spinning plexifilamentary film-fibril strands consisting essentially of 8 to 35 weight percent of a fiber-forming polyolefin and 65 to 92 weight percent of a hydrocarbon/co-solvent spin liquid, the spin liquid consisting essentially of less than 90 weight percent of a hydrocarbon spin liquid selected from the group consisting of isobutane, butane, cyclobutane, 2-methyl butane, 2,2-dimethyl propane, pentane, methyl cyclobutane, cyclopentane, 2,2-dimethylbutane, 2,3-dimethylbutane, 2-methylpentane, 3-methylpentane, hexane, methyl cyclopentane, cyclohexane, 2-methyl hexane, 3-methyl hexane, heptane and mixtures thereof and greater than 10 weight percent of a co-solvent spin liquid having lower solvent strength than said hydrocarbon spin liquid and having an atmospheric boiling point of less than 100° C. and selected from the group consisting of inert gases, hydrofluorocarbons, hydrochlorofluorocarbons, perfluorinated hydrocarbons, polar solvents and mixtures thereof.

2. The spin solution according to claim 1 wherein the fiber-forming polyolefin is selected from the group consisting of polyethylene and polypropylene.

3. The spin solution according to claim 1 wherein the co-solvent spin liquid is a polar solvent selected from the group consisting of methanol, ethanol, propanol, isopropanol, 2-butanone, and tertiary-butyl alcohol, and mixtures thereof.

4. The spin solution according to claim 1 wherein the cloud point pressure of the spin solution is greater than 900 psig at temperatures of 300° C. or less.

5. The spin solution according to claim 1 wherein the cloud point pressure of the spin solution is greater than 1500 psig at temperatures of 300° C. or less.

6. The spin solution according to claim 1 wherein said co-solvent is a perfluorinated hydrocarbon.

7. The spin solution according to claim 1 wherein said co-solvent is a hydrofluorocarbon.

8. The spin solution according to claim 1 wherein said co-solvent is a hydrochlorofluorocarbon.

* * * * *